United States Patent [19]

Dola et al.

[11] 4,386,820

[45] Jun. 7, 1983

[54] MODULAR CONNECTOR FOR POWER SYSTEMS

[75] Inventors: Frank P. Dola, Port Richey; Vincent Nicholas, Brooksville, both of Fla.

[73] Assignee: AMP Incorporated, Harrisburg, Pa.

[21] Appl. No.: 182,345

[22] Filed: Aug. 29, 1980

[51] Int. Cl.[3] ..... H01R 13/64; H01R 27/02

[52] U.S. Cl. ..... 339/156 R; 339/99 R; 339/166 R; 339/186 M

[58] Field of Search ..... 339/107, 154–166, 339/170, 184, 185, 186, 210, 211

[56] References Cited

U.S. PATENT DOCUMENTS

| | | | |
|---|---|---|---|
| 1,867,381 | 7/1932 | Sadacca | 339/166 R |
| 1,997,081 | 4/1935 | Reynolds | 339/211 |
| 2,977,562 | 3/1961 | Benson | 339/17 |
| 3,023,394 | 2/1962 | Hubbell | 339/186 M |
| 3,636,495 | 1/1972 | Forsyth, Jr. | 339/107 |
| 3,714,617 | 1/1973 | Bright et al. | 339/186 M |
| 3,745,515 | 7/1973 | Michaels | 339/156 R |
| 4,159,862 | 7/1979 | Funck | 339/186 M |

FOREIGN PATENT DOCUMENTS

| | | | |
|---|---|---|---|
| 190809 | 8/1937 | Switzerland | 339/166 R |

OTHER PUBLICATIONS

IBM Tech. Discl. Bulletin, Bombara et al., vol. 21, No. 2, pp. 519–521, 7–1978.

*Primary Examiner*—Neil Abrams

*Attorney, Agent, or Firm*—F. Brice Faller

[57] ABSTRACT

Modular connector for use in electrical power distribution systems permits modification of system by changing position of connector or removing or adding a connector. Connectors have pin and socket terminals therein with pins encased in hollow male legs extending from one face and sockets encased in hollow female legs extending from opposing face so that mating connectors may be stacked by mating legs. Connector employs a keying member which permits positive protection against misalignment of circuit elements.

5 Claims, 18 Drawing Figures

L2 & L5 SWITCHED

L4, L5 & L6 SWITCHED

MODULAR CONNECTOR FOR POWER SYSTEMS

BACKGROUND OF THE INVENTION

1. The Field of the Invention

The instant invention resides broadly in the field of electrical wiring and more particularly in the field of modular electrical wiring.

In modern commercial construction, it is generally desirable to provide as much uninterrupted floor space as is possible. To accommodate this goal, the heating, cooling, and electrical systems are located either overhead in the space provided above a suspended ceiling or in trenches under the flooring system. However, the suspended ceiling system is generally favored. Open floor space may be arranged in any number of ways to accommodate varied uses but rearrangement usually involves changes in the power distribution system which may frequently entail many technician hours in locating and rerouting electrical circuits. In addition to the problem of the physical location of electrical circuits, there is generally a need to provide branch or service outlets for the electrical equipment.

2. The Prior Art

Prior art solutions to the power distribution problem include electrified ceiling grids, electrified construction or space division panels and floor to ceiling electrified poles. Each of the prior art systems has merit in its particular application. However, each of the systems requires a variety of specialized connectors for interconnecting the various circuits and branch systems. A typical distribution system provides a plurality of distribution outlet taps into which branch wiring circuits are connected. Each branch circuit is provided with a connector plug which is plugged into an outlet at the distribution fixture. A large number of outlets are provided in the fixture for addition of future branch circuits, but these outlets become wasted capacity if they are not utilized. Each branch circuit wire must be provided with an electrical plug compatible with the distribution fixture. Each distribution fixture must have outlets facing in various directions and have a design for accommodating the aforementioned plugs. Considerable labor is required to wire each socket and to provide capacity for future needs, which results both in increased size of the system and system cost.

SUMMARY OF THE INVENTION

The present invention provides a modular connector with programmable keying which may be readily adapted to changed requirements. The connector has opposed faces with hollow male legs extending from one face and hollow female legs extending from an opposed face which are axially aligned with the male legs. Terminals in the connector have one mating portion inside the male leg and an opposed mating portion inside the opposed female leg. Individual conductors of a cable sandwiched between halves of the connector are splayed through channels from a cable receiving end of the connector to the terminals where they are connected to individual terminals between the mating ends thereof. Legs with terminals therein are positioned symmetrically on the connector so one connector may be mated to the next in any number of orientations, but only one orientation is possible for a given position of keying which also mate, but only in one orientation. The keying legs also have terminals therein and are part of keying members variably positioned in each half of the connector centrally of the other legs. By properly orienting the keying members relative to the conductors it is possible to develop in line and branch circuits or switching by using connectors affixed to ends of cable.

It is an object of this invention to provide a stackable wiring module for system use.

It is a further object of this invention to provide a wiring module having a variable position keying member.

It is an object of this invention to provide a space conserving wiring module system.

BRIEF DESCRIPTION OF THE DRAWINGS

FIG. 1 is a perspective of the assembled modular connector.

DETAILED DESCRIPTION OF THE PREFERRED EMBODIMENT

Figure 2:
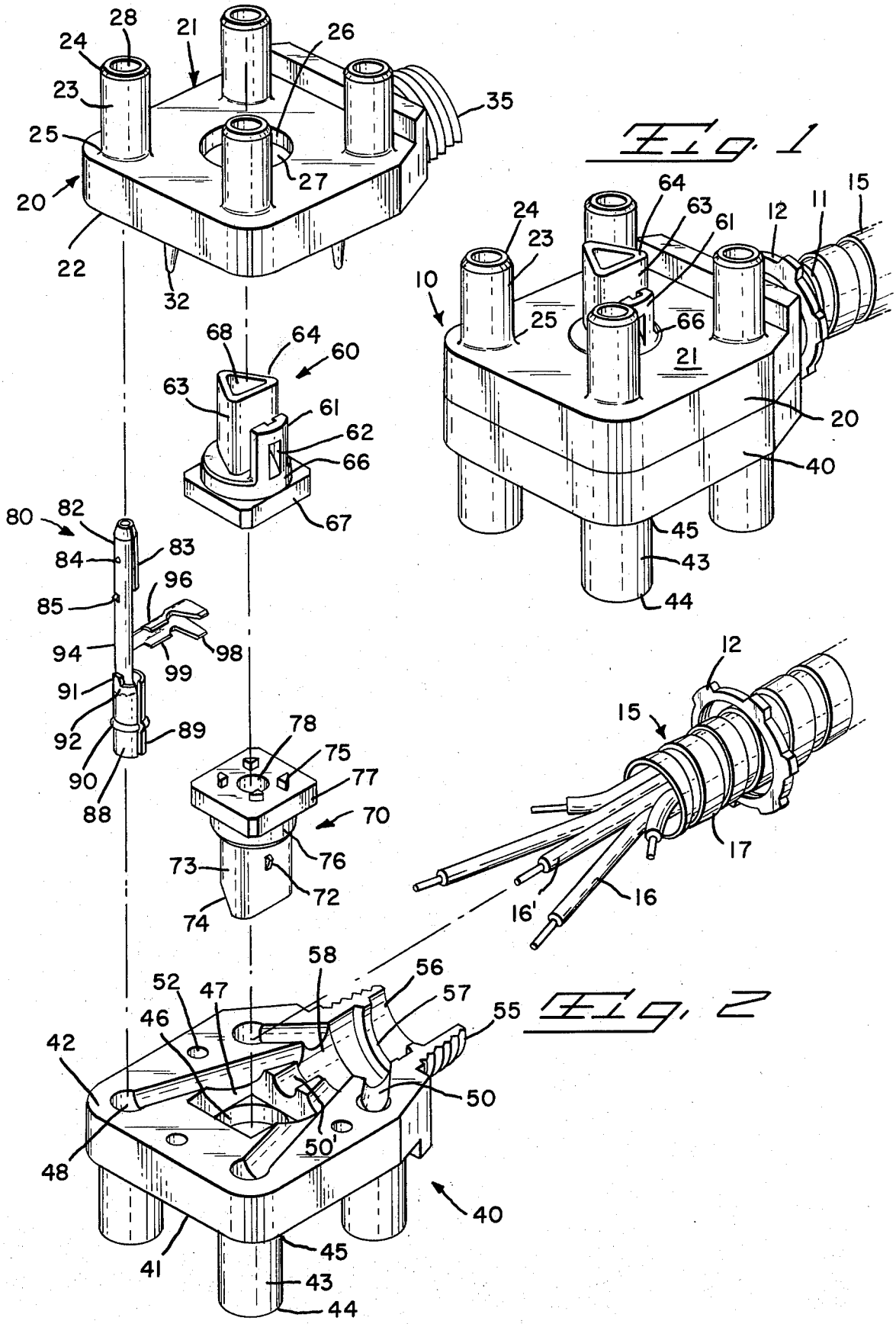
FIG. 2 is an exploded perspective of the connector.

The preferred embodiment will be described in conjunction with a five conductor system comprised of a system ground, two hot conductors, and two neutral conductors. It should be recognized that this is only for the purpose of illustration and that a five conductor housing will accommodate a three conductor system as well as other varied five conductor systems.

FIG. 1 depicts an assembled modular connector 10 which terminates a five conductor jacketed cable 15. The connector comprises a male housing 20 having a first face 21 with four cylindrical male legs 23 extending normally of the face 21 and a female housing 40 having a first face 41 with four cylindrical female legs 43 extending normally of the face 41. Each cylindrical male leg 23 has a remote end 24 and a housing end 25. Each cylindrical female leg 43 likewise has a remote end 44 and a housing end 45. A triangular male keying leg 63 extends from first face 21 centrally of the cylindrical male legs 23 and a triangular female keying leg 73 (not visible) likewise extends from first face 41 between cylindrical female legs 43. Each triangular male keying leg 63 has a remote end 64 and a round pedestal 66 which is flushly within first face 21 of the male housing 20. The module has a threaded cable receiving end 11 and a nut 12 threaded thereon.

FIG. 2 is an exploded perspective of a single connector showing its component parts in greater detail. The male housing 20 has a second face 22 which fits flushly against second face 42 of female housing 40. Second face 22 has three conical pins 32 extending therefrom which fit into respective aligning holes 52 in second face 42 to align the male housing 20 to the female housing 40. Each cylindrical male leg 23 has a passage 48 therethrough which communicates with second face 42. The second face 22 of male housing 20 is a mirror of second face 42 of female housing 40; the features profiled in the latter will be discussed. A cable receiving end 55 of the housing 40 is profiled internally with a trough 56 semi-circular in cross section which is further profiled with a series of ribs 57. The trough 56 communicates with a manifold recess 58 in second face 42. Four channels 50 irradiating from the manifold recess 58 communicate with bores 48 which extend through the housing and respective female cylindrical legs. A fifth channel 50' communicates with a square profiled recess 47 located centrally of the four bores 48. A round opening 46 extends between the bottom of square recess 47 and first face 41 of housing 40.

Male keying member 60 has a resilient latching member 61 adjacent one face of the triangular male keying leg 63 which extends from the round pedestal 66 toward the remote end 64 of the leg. The latching member 61 has a square hole 62 therein profiled to mate with a lock tab 72 on the female keying leg 73 as will be described. The round pedestal 66 sits on a square profiled base 67 which is profiled to fit in square recess 27 in the second face 22 as the round pedestal 66 fits through round hole 26 which communicates with first face 21. The male keying member 60 has a passage 68 extending axially therethrough. Female keying member 70 has a passage 78 extending axially therethrough and four projections 75 on the square base 77 which mirror projections 65 on the square base 67. Male and female keying members 60, 70 are referred to collectively as the keying element.

The terminal 80 is stamped from brass sheet to form a pin 82 and a socket 88 on a common linear axis with a web 94 therebetween. The pin 82 has a stub 84 on its surface and a lance 85 struck through the surface of the pin adjacent to the web 94. The socket 88 has a ridge 90 protruding about its circumference and a lance 91 struck through the surface of the socket 88 adjacent to web 94. The socket is formed by wrapping sheet metal into a cylindrical shape with an interior diameter sufficient to accommodate the pin 82 of a similar terminal. The pin 82 has a gap 83 as a result of the forming and the socket likewise has a gap 89. The web 94 has a flag member 96 which extends laterally of the axis of the terminal to a crimp barrel 98 which grips a pre-stripped portions of a conductor 16 and a strain relief barrel 99 which grips insulation on the conductor 16.

Figure 3:
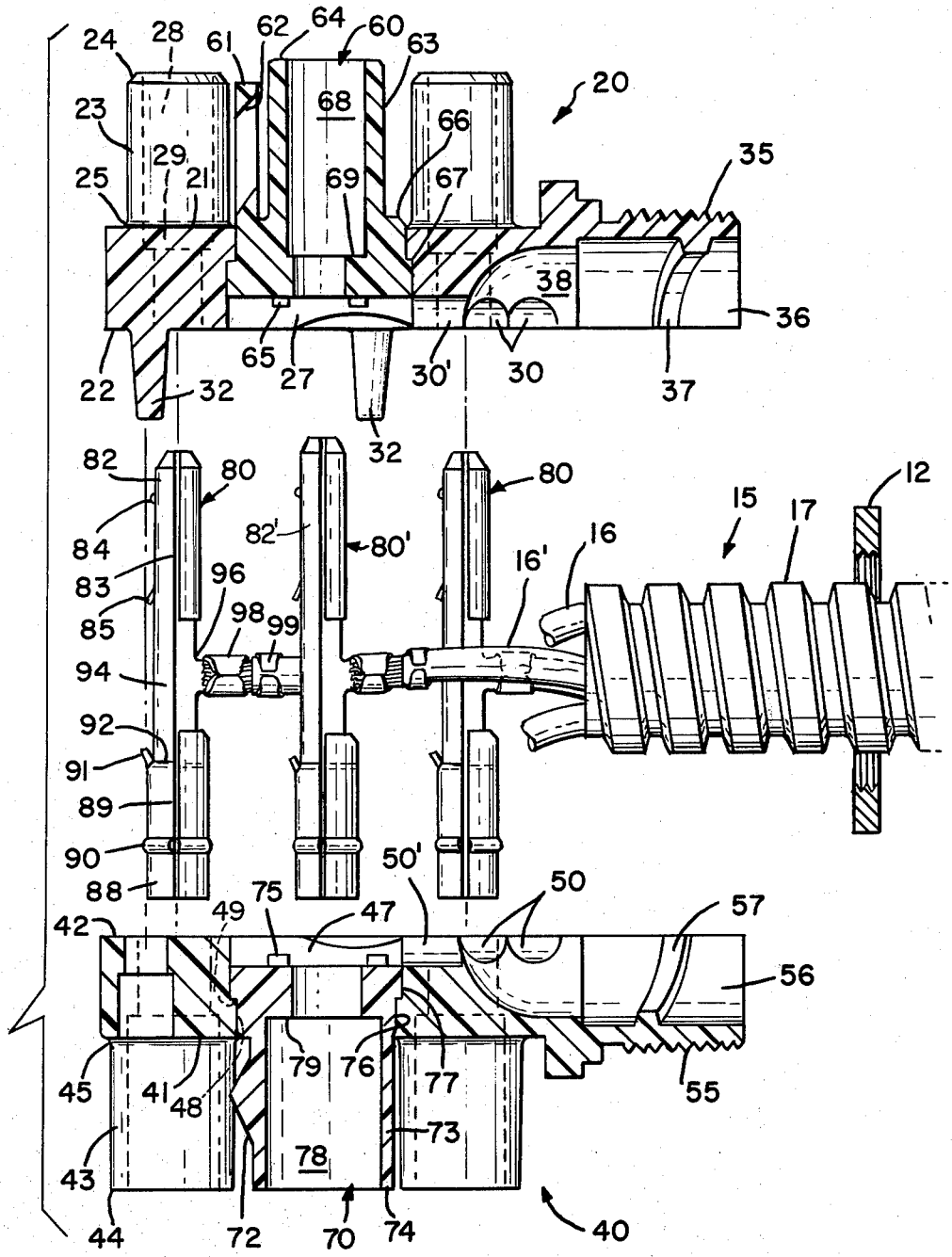
FIG. 3 is a section view of the housings with keying members therein prior to assembling the connector.

FIG. 3 depicts the male and female housings 20, 40 with the respective keying members 60, 70 assembled thereto and terminals 80 attached to conductors 16, 16' of the cable 15. The cable 15 is standard flexible conduit with a metallic spiral jacket 17. The ridges 37, 57 in the respective housing, ends 25, 55 form a helix when the housings 20, 40 are assembled which complements the spiral jacket 17. The passages 28 through the male legs 23 have shoulders therein which restrict the diameter of the passage in the housing 20 toward the second surface 22, the diameter of the restricted portion being substantially equal to the diameter of a terminal pin 82. The passages 48 through the female legs 43 have shoulders 49 therein which restrict the diameter of the passage in the housing 40 toward the second surface 42. The diameter of the passage 48 between the shoulder 49 and the remote end 44 is sized to closely accommodate a male leg 23, while the diameter of the passage between the shoulder and the second face is sized to closely accommodate a socket 88. The passage 68 through the male keying leg 63 is triangular in cross section toward the remote end 64 and meets a shoulder 69 which restricts the passage to a circular cross section through the square base 67, the diameter of the restricted portion here being sized to closely accommodate a pin 82. The passage 78 through female keying member 70 is triangular in cross section toward the remote end 74 and is profiled to closely accept a male leg in another module. The passage 78 meets a shoulder 79 which restricts the passage to a circular cross section through the square base 77, the diameter of the passage here being sized to closely accommodate a socket 88. Note that the male keying leg 63 is slightly longer than the male cylindrical legs 23 and the pin 82' is likewise somewhat longer. All prime notations will refer to the grounding wire and grounding terminal. This design is for the purpose of complying with an Underwriters Laboratories requirement that ground terminals be the first to mate and last to break away. Likewise terminals must be at least $\frac{1}{8}$ inch below the remote end of the leg in which they are located.

Figure 4:
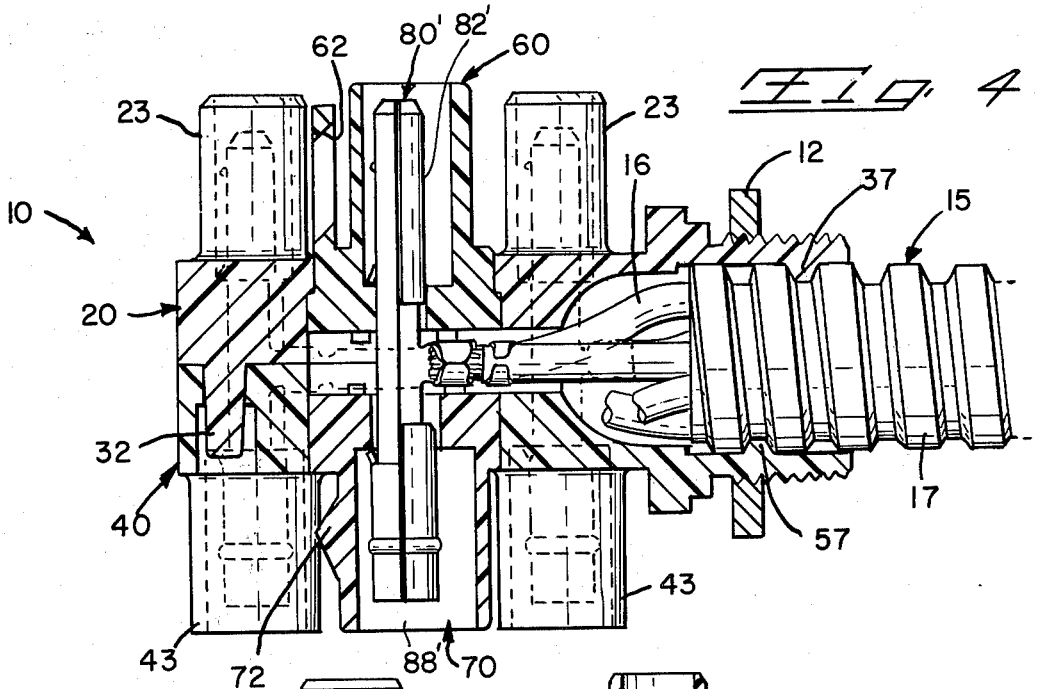
FIG. 4 is a section view of the assembled connector.

To assemble the connector, the metallic spiral jacket 17 is first cut away to expose the insulated conductors 16, 16' which are cut and stripped as shown in FIG. 2. A nut 12 is then slid over the cable and the terminals 80 are crimped to the conductors as shown in FIG. 3. The female keying member 70 is inserted into the female housing 40 with the square base 77 fitting into the square recess 47 in one of four orientations as will be described. The sockets 88 are then inserted into passages 48, 78 until lances 91 pass over shoulders 49, 79. The socket passages 48, 78 compress the sockets 88 as they pass through the portions of the passages between the shoulders 49 and the second face 42 to provide a snug fit. The snug fit is a benefit of fabricating a metal with a good spring characteristic such as brass. When the sockets are fully inserted in the passages, the conductors 16, 16' lie in channels 50, 50' and the spiral jacket 17 fits into the trough 56 in the cable receiving end 55 and cooperates with the ridges 57 therein. The male keying member 60 is next positioned in the male housing 20 in the desired orientation and the male housing 20 is positioned against the female housing 40 so that the second faces are 22, 42 against each other and the conical pins 32 fit into aligning holes 52. See FIG. 4. The pins 82 are received in passages 28, 68 until lances 85 pass over shoulders 39, 69 and the trough 36 in cable receiving end 35 fits over the cable 15 so that the ridges 37, 57 form a complete helix to provide strain relief for the spiral cable jacket 17. The pins 82 are compressed in the passages 28, 68 to provide a snug fit similar to the sockets in the female housing lances 82, 92 fit over shoulders in respective male and female parts to lock the housing together. The nut 12 serves the dual function of holding cable receiving ends 35, 55 together as well as securing the completed module 10 to an aperture in a mounting surface such as sheet metal.

Figure 6:
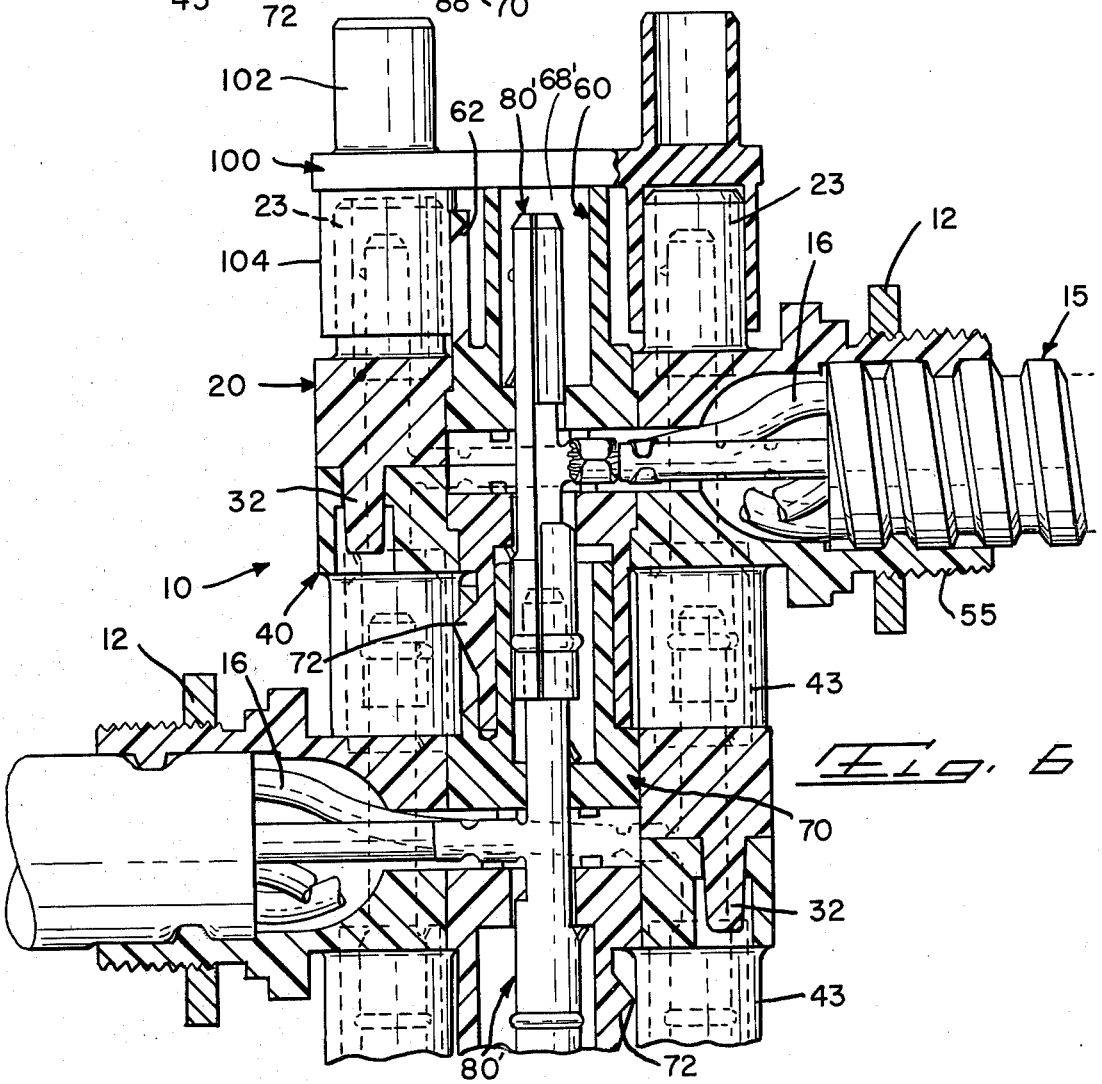
FIG. 6 is a section view of two mated connectors.
Figure 5:
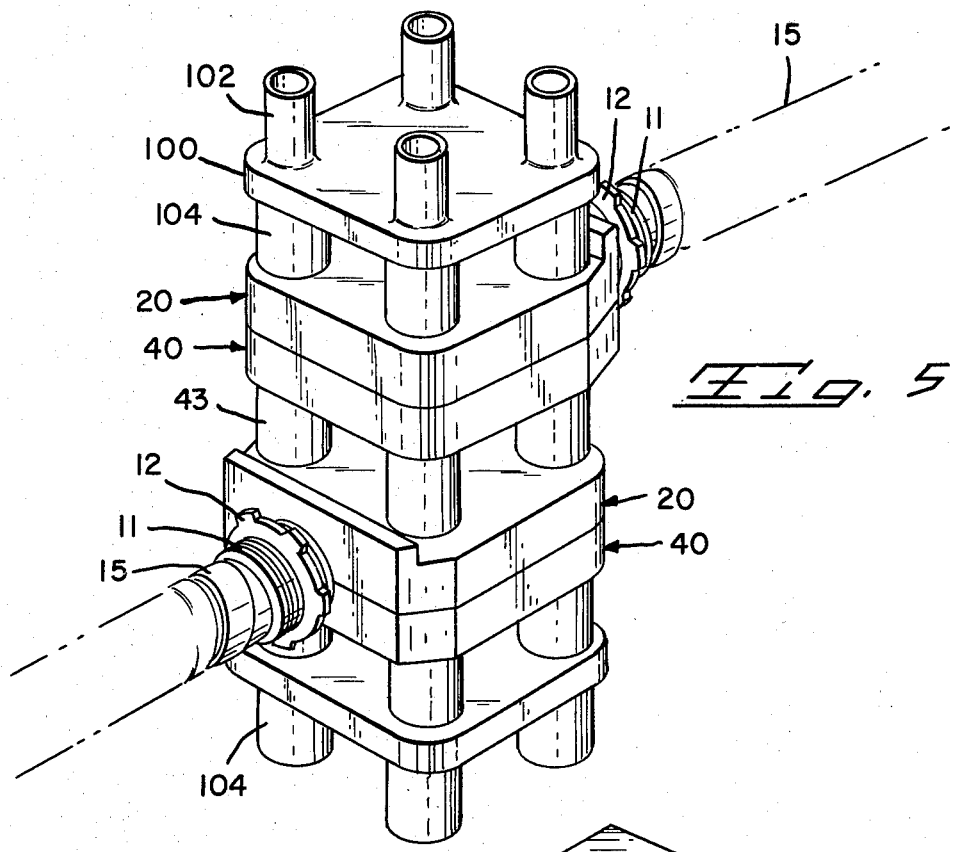
FIG. 5 is a perspective view of two mated connectors.

The modular connector may now be stacked as shown in FIG. 5 by fitting the remote ends 24 of the male legs 23 into the passages 48 in the remote ends 44 of the female legs 43. The male keying leg 63 fits into the passage 78 in female keying leg 73 until the resilient latching member 61 snaps over the lock tab 72 as shown cross sectionally in FIG. 6. The sockets 88 expand slightly and the pins 82 are compressed until the stub 84 fits inside the stamped ridge 90. All conductors are firmly entrenched in channels profiled in the respective housings. FIGS. 5 and 6 also depict environmental covers 100 in place. Each cover has four hollow male legs 102 on one side and four hollow female legs 104 on the other side which are positioned and profiled to mate with female leg 43 or male legs 23 on a female housing 40 or a male housing 20. There is no center member or through hole in the cover, which is placed on the ends of a stack of modules to protect the terminals from damage, contamination, or arcing.

Figure 7A:
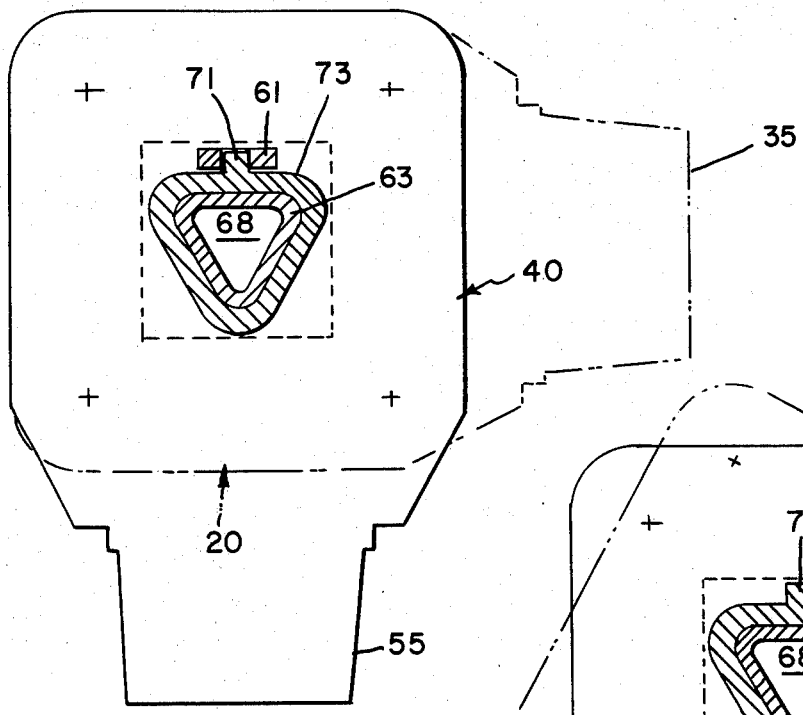
FIG. 7A illustrates the keying members properly mated.
Figure 7B:
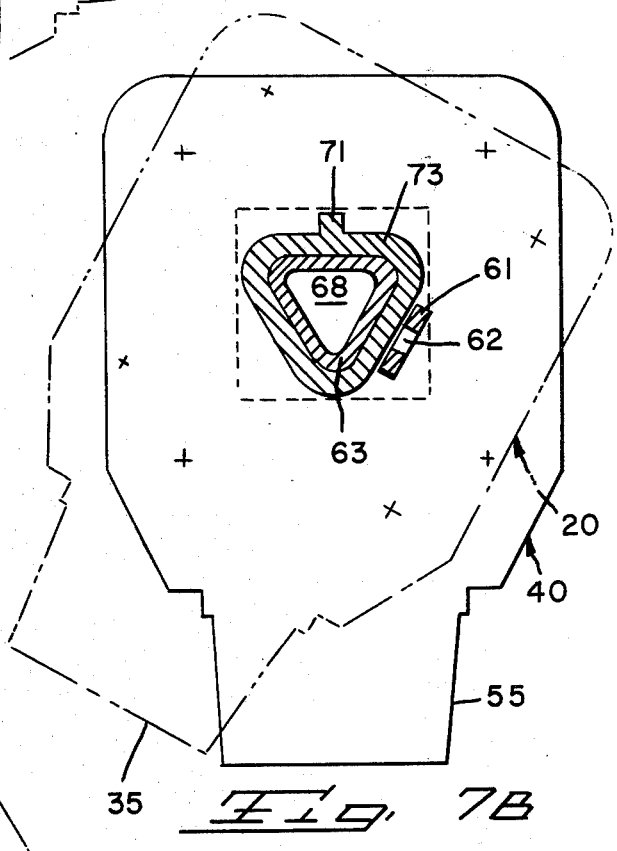
FIGS. 7B and 7C illustrate the keying members improperly aligned.
Figure 7C:
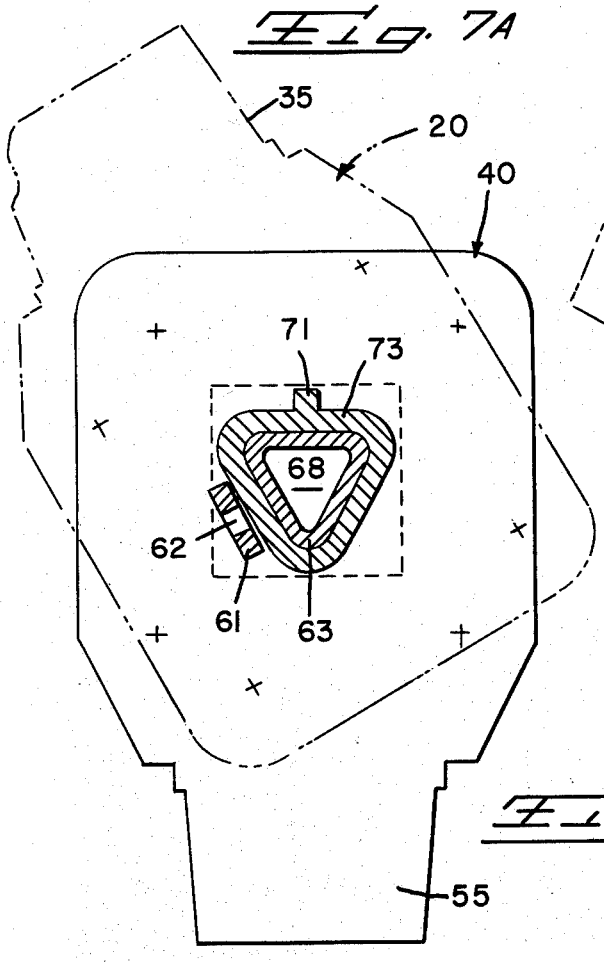

FIGS. 7A, 7B, and 7C illustrate the keying feature of the keying members 60 and 70. In each figure the male housing 20 is shown in phantom and the female housing 40 in solid lines. Two complete connectors cannot be electrically interconnected unless the keying legs 63, 73 are aligned as shown in FIG. 7A. As shown in FIGS. 7B and 7C, efforts to frustrate the keying feature will result in no electrical interconnection. Note, however, that the 90 degree orientation of the housings 20, 40 shown in FIG. 7A has been predetermined by the orientation of the square bases 67, 77 of the male and female keying members 60, 70 respectively in the respective square recesses 27, 37 of the housings. The orientation of the housings will generally be determined by the physical layout of a system. For example, a module mounted on top of a light fixture with the legs horizontal will generally be connected to module of an input cable in one of two 90 degree orientations as will be illustrated. The terminals which occupy the legs in each module will have like polarity in each module and must therefore be properly placed for a given key orientation. Note in FIG. 4 that the pin and socket are recessed from the remote ends of the respective legs, so that if pins and sockets are aligned while keying members 60 and 70 are not, electrical connections is not possible.

A major advantage of the subject connector with the keying element is that the module orientations and terminal placement may be determined in advance of field installation, so that a field electrician need only plug a given module into the proper mating module per instructions prepared for a given system. The keys or modules may be color coded to aid in identification. As cables with modules attached may be prepared in advance, field installation time is reduced considerably. This is desirable since labor rates for electrical work done in a shop are generally much lower than those for field work.

Figures 8A, 8B:
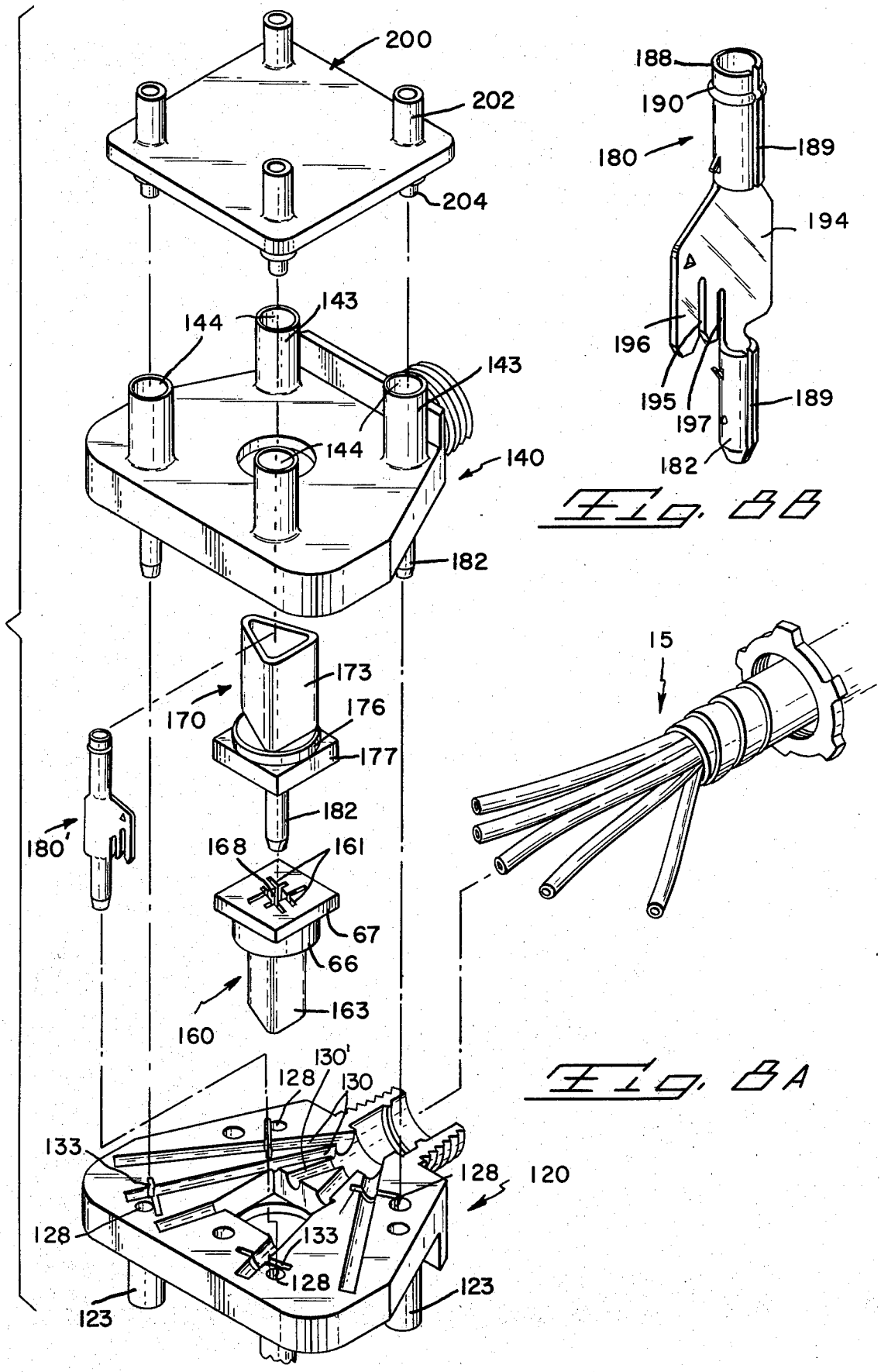
FIG. 8A is an exploded perspective of an alternative embodiment of the connector.
FIG. 8B is a perspective of the terminal of the alternative embodiment.

FIG. 8A shows an alternative embodiment which uses the insulation displacing terminal 180 depicted in FIG. 8B. Notice at once that these figures depict the female housing 140 above the male housing 120. Reference numerals are generally the same as for the first embodiment but in the 100 series. Again the ground terminal will use prime numbers. The terminal 180 is a brass pin and socket with a web 194 having a flag member extending therefrom in the form of a flat blade 196. The flat blade 196 has an insulation displacement slot 195 therein parallel to the axis of the terminal as well as a relief slot 197 between the slot 195 and the axis. The cable 15 is as previously described, however, there is no need to cut the individuals conductors to a particular length or to strip the conductors since the channels 150 in the male housing 120 respectively are all the same length. The channels in the female housing 140 are not visible here but mirror those in the male housing 120 as with the embodiment previously described. Blade slots 133 intersect each channel at a different point along its length adjacent to the passages 128 at the four corners of the housing which receive the terminals. The male keying member has two pairs of parallel blade slots 161 arranged in parallelogram-like manner about passage 168. The female keying member has similar slots. Note that the male and female keying members here are like isosceles triangles in cross section, which is an alternative keying arrangement insofar as only one orientation will permit mating. Other alternatives are possible where it is desireable not to have a connector mateable to more than one other in an extensive system. Note that an alternative environmental cover 200 is also shown, the cover having hollow female legs 202 which fit inside of the male legs 123 and surround the pin 182 therein, the cover 200 having male legs 204 which fit only in the remote ends 144 of the female legs 143, legs 204 having pegs which fit in the sockets 188 in the female legs 143. Again the keying legs 163, 173 and terminals 180' therein are $\frac{1}{8}$ inch longer than the other legs for safety reasons.

Figure 9A:
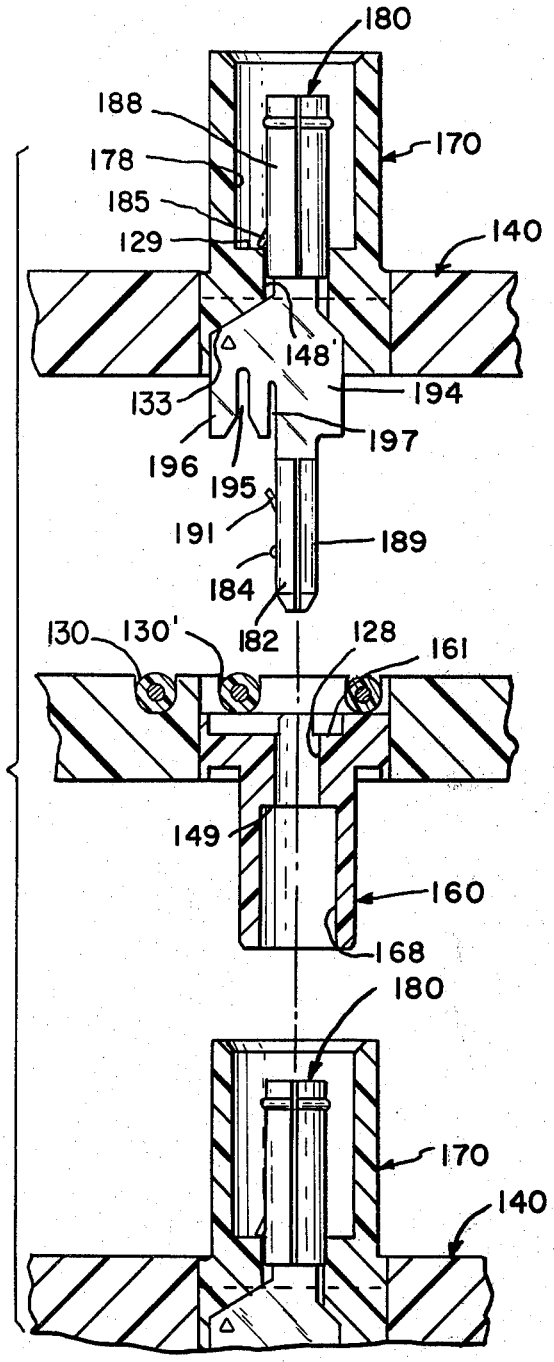
FIGS. 9A and 9B are section views of the alternative embodiment.
Figure 9B:
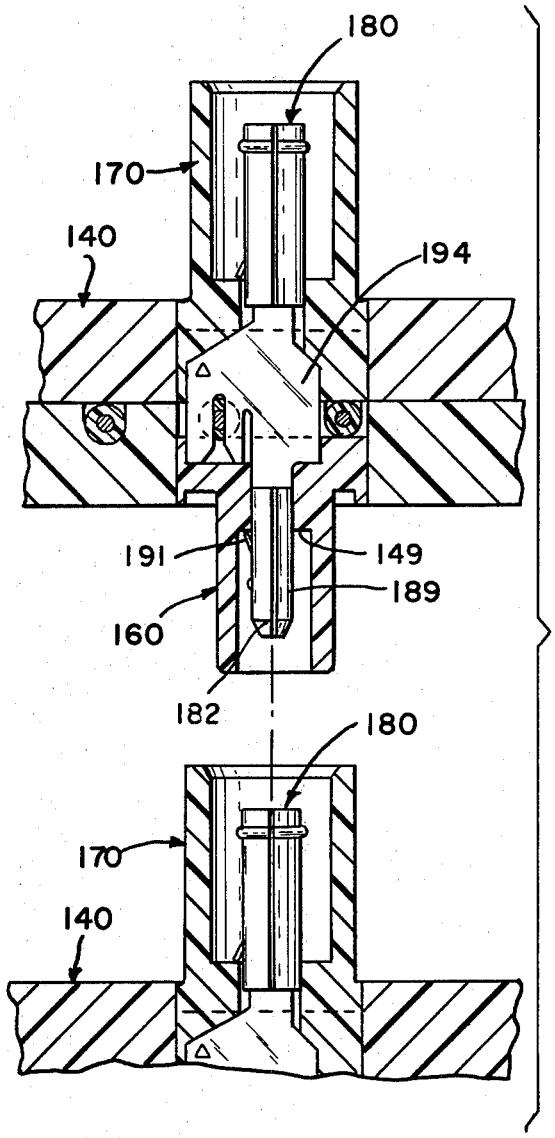

Referring to FIGS. 9A and 9B, the alternative embodiment is assembled by first placing keying members in the respective housing in predetermined orientation as before then placing the conductors on the channels 130, 130' in the male housing. The sockets 188 are then inserted into passages 148, 178 in the female housing so that the tops of blades 196 enter the blade slots 133 and abut the bottoms of the slots 161, and lances 185, 191 snap over internal shoulders 129, 149. The female housing 140 is then fit against the male housing 120 so that the pin ends 182 of the terminals 180 enter the passages 128, 168 and the bottoms of blades 196 enter blade slots 133. This causes the insulation displacing slots 195 to displace insulation from the conductors while the relief slot 197 allows the blade slot 195 to expand slightly for a good resilient termination. The array of slots 161 allows the keying member 160 to be rotated for keying without altering the termination position of the blade 196.

The insulation displacing module is mated to an identical module in the same manner as the embodiment which utilizes a terminal crimped to the conductor, however, the two embodiments are not interchangeable since the insulation displacing version is larger.

Figure 10:
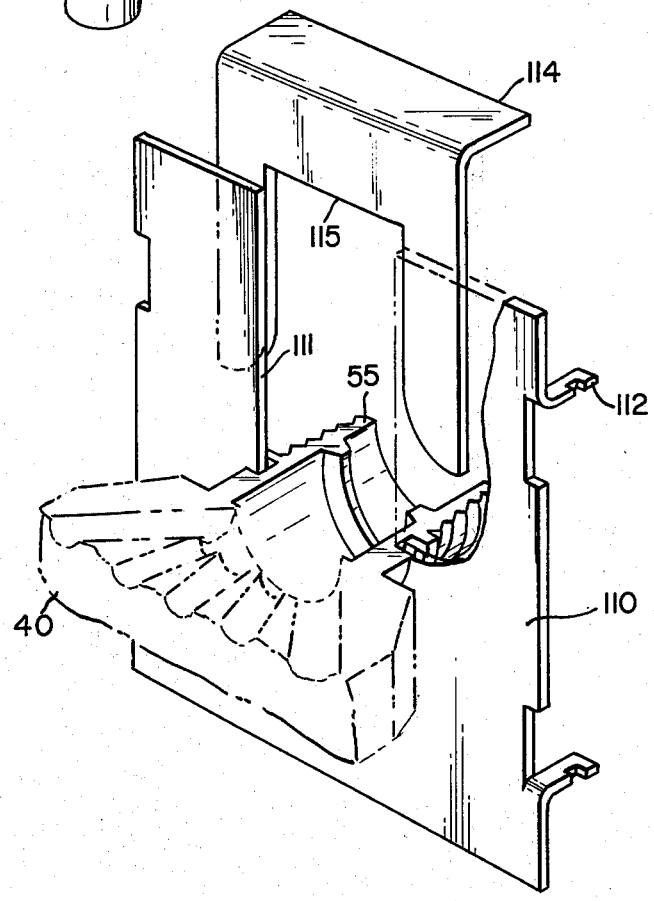
FIG. 10 is a perspective of a mounting means for the connector.
Figure 11A:
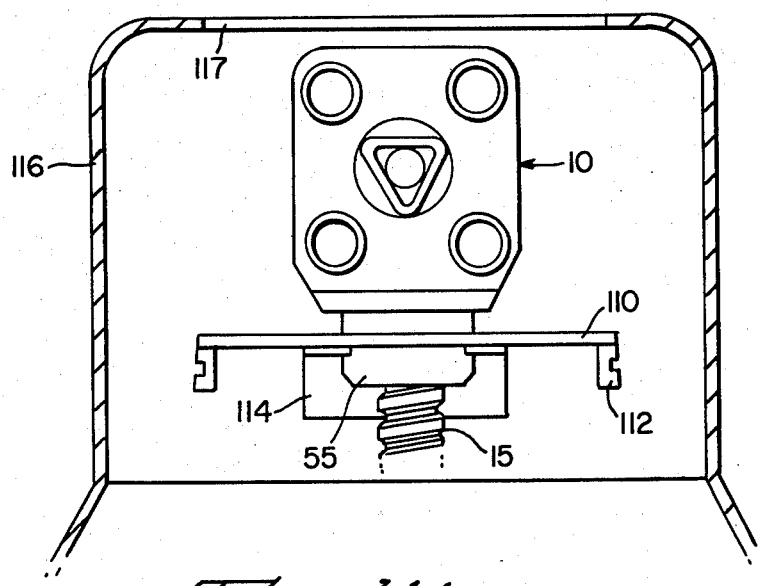
FIGS. 11A and 11B are plan views of the connector in a light fixture.
Figure 11B:
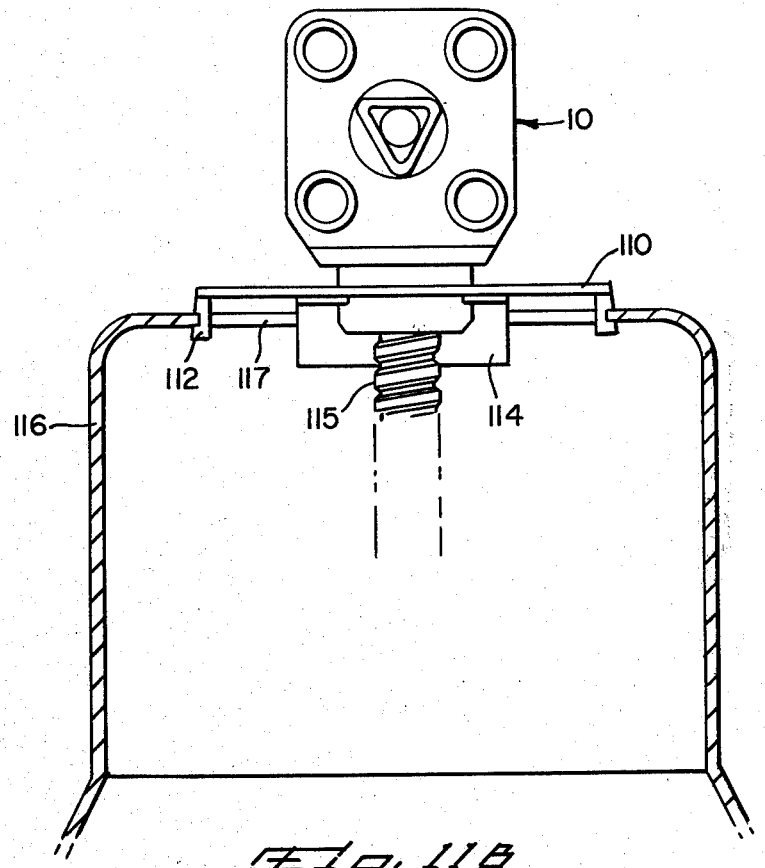

FIG. 10 depicts a mounting scheme whereby the module 10 may be mounted in sheet metal, typically a light fixture. For clarity only a housing 40 is shown, but it should be understood that the assembled module 10 is involved. First the conductor receiving end 55 of the module is placed in a U-shaped cut 111 in the sheet metal, here a cover 110 with latches 112 on the edges. A clip 114 with a U-shaped cut 115 therein is then placed over the conductor receiving end 55 to lock it in place as shown. FIG. 11A shows the arrangement of a module inside a light fixture 116 where it would typically be stored during shipping, and FIG. 11B shows the cover 110 latched into place in an aperture 117 in the top of the light fixture. Thus the module occupies no additional space over that occupied by the lighting fixture 110 during shipping, but may readily be attached externally of the fixture for ready mating to a module on an incoming cable 15.

Figure 12A:
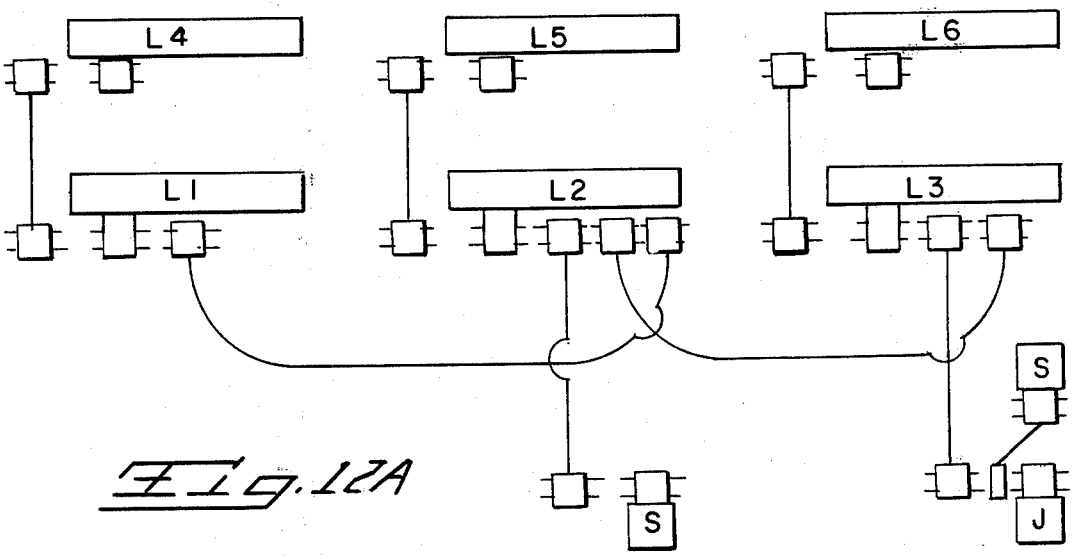
FIGS. 12A and 12B are schematic plan views of switching arrangements using the modular connector.
Figure 12B:
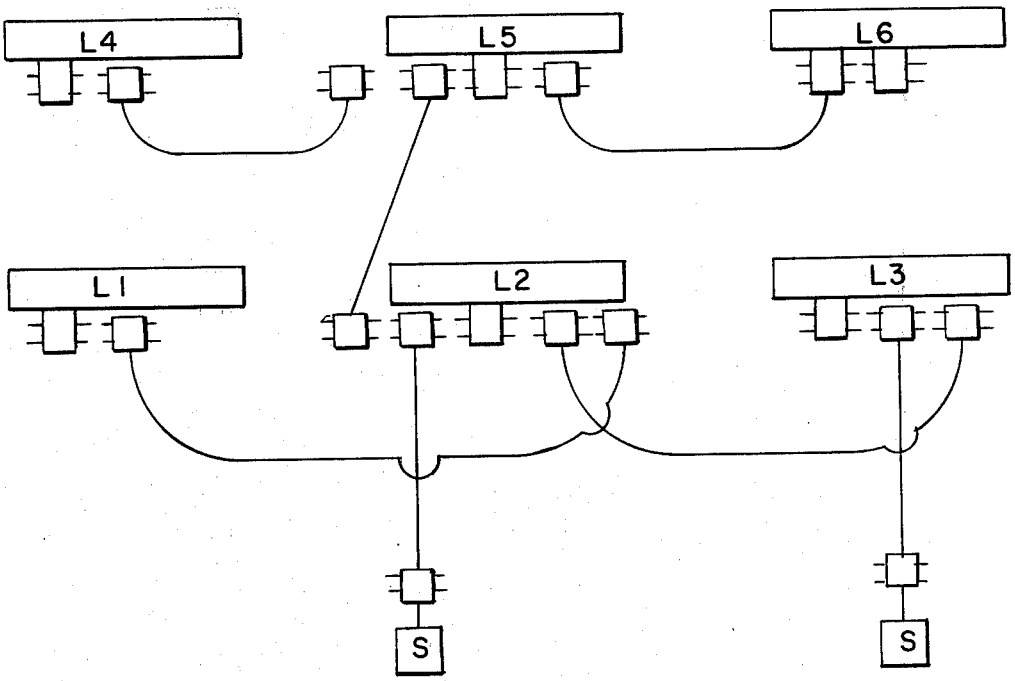

FIGS. 12A and 12B illustrate the use of the connector in a simple system which comprises six lighting fixtures, a junction box, and two switches. Note that by modifying the stacking array and relocating a few connectors a different array of switched lights may be attained without additional switching. Additional lighting fixtures and switching may readily be added to such a system, the only limiting factor being the current load, which is typically limited to 30 amps. Note that relocation of connectors may necessitate altering the keying arrangement, which would require a special tool insertable into the legs on one face of a connector to depress the lances so the housings could be pried apart. This operation could be done in a shop while replaced by a new cable with preassembled connectors affixed to the ends.

The foregoing description is illustrative of the invention and is not intended to limit its scope.

What is claimed is:

1. A modular connector, comprising:

a first plurality of conductive terminals, each said terminal having a first mating end and a second mating end on a common linear axis with an integral web therebetween, said web having termination means thereon, said first end of one such terminal being matable to said second end of another such terminal by moving said first end of one such terminal axially toward said second end of another such terminal, a male housing having a first face and a second face, said first face having a first plurality of parallel male legs extending therefrom, each said leg having a remote end and a housing end, each said leg having a passage extending axially inward from said remote end to said housing end, each said passage communicating with said second face, one of said male legs being a male keying leg having a certain external profile, said keying leg being positioned centrally of the remaining male legs, said remaining male legs being a second plurality, said remaining male legs having radial symmetry about said male keying leg, said male keying leg being an extension of a male keying member having a profiled base which complements a profiled recess in said second face of said male housing in a second plurality of orientations, a female housing having a first face and a second face, said first face having a first plurality of parallel female legs extending therefrom, each said leg having a remote end and a housing end, each said leg having a passage extending axially inward from said remote end to said housing end, each said passage communicating with said second face and being profiled to accommodate a male leg, one of said female legs being a female keying leg, said passage having a certain internal profile which complements said certain external profile of said male keying leg, said female keying leg being positioned centrally on the remaining female legs, said remaining female legs being a second plurality, said remaining female legs having radial symmetry about said female keying leg, said female keying leg being an extension of a female keying member having a profiled base which complements a profiled recess in said second face of said female housing in a second plurality of orientations, each said orientation being such that one modular connector can be mated with another modular connector in only one orientation, whereby, a modular connector may be assembled by terminating a conductive element to said termination means on each of said terminals and sandwiching said terminals between said second faces of said male and female housings, each said terminal having its first end received in the passage of a male leg and its second end received in the passage of a female leg, said second faces being profiled to accommodate said termination means and said conductive elements therein, said modular connector being matable to another said modular connector by inserting said remote ends of said male legs into the passages in the remote ends of the female legs of said other modular connector, said first ends of said terminals in said modular connector mating to said second ends of said terminals in said other modular connector, and said orientation of each said keying leg relative to its housing may be changed by removing the respective keying member from the housing and rotating it to another orientation where said base complements said profiled recess and inserting the keying member back into the housing, said keying legs shaped to permit or prevent mating depending upon their rotational orientation.

2. A modular connector as in claim 1 wherein said first end of each said terminal is a pin and said second end of each said terminal is a socket.

3. A modular connector as in claim 1 wherein said certain external profile of said male keying leg is triangular.

4. A modular connector as in claim 1 wherein said terminals and male and female housing members have cooperative locking means which retain said terminals in said housing and further retain said male housing in its position as assembled to said female housing when one or more of said terminals are sandwiched therebetween.

5. A modular connector as in claim 1 wherein there are four remaining male legs, each located at the corner of a square array, and four female legs, each located at the corner of a like square array, said profiled base of each keying member being square, whereby, each keying member can be assembled to the respective housing in four possible orientations, so that each housing may be mated to the complementary housing in four possible orientations.

* * * * *